United States Patent [19]

Nozaka et al.

[11] Patent Number: 4,991,507

[45] Date of Patent: Feb. 12, 1991

[54] CLEANING SYSTEM FOR OFFSET SHEET-FED PRINTING PRESSES

[75] Inventors: Yoshiki Nozaka, Tokyo; Shinya Fujino, Kawagoe; Hiroshi Miyama, Tokyo, all of Japan

[73] Assignee: Dai Nippon Insatsu Kabushiki Kaisha, Tokyo, Japan

[21] Appl. No.: 424,179

[22] Filed: Oct. 19, 1989

[30] Foreign Application Priority Data

| | | | |
|---|---|---|---|
| Oct. 19, 1988 | [JP] | Japan | 63-261395 |
| Feb. 7, 1989 | [JP] | Japan | 1-26621 |
| May 1, 1989 | [JP] | Japan | 1-112434 |

[51] Int. Cl.[5] ..... B41F 35/00

[52] U.S. Cl. ..... 101/425; 101/423

[58] Field of Search ..... 101/423, 425, 119, 120

[56] References Cited

U.S. PATENT DOCUMENTS

| | | | |
|---|---|---|---|
| 4,638,733 | 1/1987 | Schneider et al. | 101/119 |
| 4,922,821 | 5/1990 | Nozaka et al. | 101/425 |

FOREIGN PATENT DOCUMENTS

| | | | |
|---|---|---|---|
| 476011 | 8/1951 | Canada | 101/425 |
| 227927 | 10/1985 | Canada | 101/425 |
| 257818 | 3/1988 | European Pat. Off. | 101/425 |
| 061857 | 3/1986 | Japan | 101/425 |

*Primary Examiner*—Edgar S. Burr
*Assistant Examiner*—Ren Yan
*Attorney, Agent, or Firm*—Parkhurst, Wendel & Rossi

[57] ABSTRACT

A cleaning system for offset sheet-fed printing presses according to the present invention comprises a magazine roll for reeling-out cleaning cloth to perform the cleaning of the impression cylinder, a take-up roll to take-up this cleaning cloth, a blade provided between the magazine roll and the take-up roll and in contact with the impression cylinder from behind the rear side of the cleaning cloth, and a guide member to bring the cleaning cloth pressed by the blade, into contact around the arcuate circumferential surface of the impression cylinder and in contact along the axial length of the impression cylinder. This cleaning system for offset sheet-fed printing presses additionally comprises a pressing member provided between the blade and the guide portion so as to press the arc-shaped contact portion of the cleaning cloth against the impression cylinder and preferably comprises a blade being provided so as to be freely capable of advancing and retreating with respect to the cleaning cloth. Each of the parts configuring the abovementioned cleaning system are housed in a frame which is freely movable on rails provided parallel to the impression cylinder.

9 Claims, 6 Drawing Sheets

CLEANING SYSTEM FOR OFFSET SHEET-FED PRINTING PRESSES

BACKGROUND OF THE INVENTION

This invention relates to a cleaning system for the impression cylinder of offset sheet-fed printing presses.

There has been continual development of blanket cylinder cleaning systems for offset printing presses and many systems for practical use have been proposed. As shown in FIG. 11, the impression cylinder 1 of the offset sheet-fed printing press, has a finger mechanism mounting space 1*a* in which is mounted a finger shaft 2 to which is mounted a finger 3, provided so that it protrudes from the surface of the impression cylinder. Because of this, even when cleaning is performed for the dirt, paper dust or the like by wiping the impression cylinder between a magazine roll and a take-up roll, the finger 3 becomes an obstruction to make automatic cleaning of the impression cylinder difficult to the extent that it has to be performed manually.

Also there is limited space around the impression cylinder and not only does such cleaning have to be made in an awkward posture, it is also dangerous as it is necessary to clean the impression cylinder while rotating it at a low speed. Moreover, the dirt stuck to the cylinder is difficult to clean off in itself and the time required for cleaning reduces the production efficiency of the printing press.

To counter this problem, cleaning systems such as the one disclosed in Japanese Patent Application Number 92456/1988 have been proposed. As shown in the sectional view in FIG. 10, indicating the status of contact between the cleaning system and the impression cylinder, the magazine roll 5 and the take-up roll 6 of the cleaning cloth 4 have the same configuration as a conventional system but the line pressure contact device is a support plate 7 that has the shape of an inverted letter V, and a blade 8 mounted to one of its ends. The cleaning cloth 4 fed out from the magazine roll 5 is pressed by this plate in a line against the impression cylinder 1, and the other end of the support plate 7 forms a guide portion 9 provided on the side of the take-up roll 6 to form a configuration whereby the cleaning cloth 4 pressed by the blade 8 to form a line against the impression cylinder 1, is guided and pressed along an arcuate circumferential surface of the impression cylinder 1 so that there is an area of contact in the form of an arcuate circumferential surface, and is then taken-up by the take-up roll 6. This is to say that the system comprises a cleaning cloth 4 to directly remove the dirt on the impression cylinder 1, a magazine roll 5 to progressively reel-out the cleaning cloth 4; a take-up roll 6 to hold and take-up the cleaning cloth 4; a blade 8 to press the cleaning cloth 4 against the impression cylinder 1, a nozzle 12 provided on the cleaning liquid supply pipe 11 and forming means to dampen the cleaning cloth 4; an inverted-V shaped support plate 7 provided with a guide portion 9 for supporting the blade 8 and the cleaning liquid supply pipe 11 and also for holding the cleaning cloth 4 on the take-up side against the surface of the impression cylinder; and a frame 13 for supporting the inverted-V shaped support plate 7 provided with a guide portion 9 holding the cleaning cloth 4 on the take-up roll side, in contact with the impression cylinder 1, and also provided with a finger 3 mounted to the finger shaft 2 inside the finger mechanism mounting space 1*a* of the impression cylinder 1. The finger shaft 2 is provided with a finger escape cam 14. In addition, the cleaning system is provided with an air cylinder as a movement system for the purposes of advancing and retreating the cleaning system to and from the impression cylinder so that contact with the impression cylinder is prevented when the impression cylinder is rotating at a high speed, and a one-way clutch and air cylinder for progressively moving the cleaning cloth and taking it up. Movement of the blade 8 to move the cleaning cloth 4 with respect to the impression cylinder 1 is performed by a suitable means. Moreover, as shown in FIG. 10, reference numeral 15 indicates a rotating support shaft 15 for bringing the frame 13 into and out of contact with respect to the impression cylinder 1. In addition, a mechanism that uses the action of a cam or the like to rotate the frame 13 around the center of a rotating support shaft 15 can be provided instead of an escape cam so that the cleaning cloth 4 does not come into contact with the finger 3.

However, in a cleaning system as disclosed in Japanese Patent Application Number 92456/1988 as described above, the cleaning of the impression cylinder is performed by a blade pressing the cleaning cloth against the surface of the impression cylinder so that the portion of the cleaning cloth in contact forms an arcuate circumferential surface around a portion of arcuate circumferential surface of the impression cylinder. Thus, is possible for dirt to be cleaned away by the blade for the portion close to the finger 3 but the remainder of the arcuate circumferential surface of contact has a small pressure force and there is a poor transfer of dirt to the cloth. Therefore, the full cleaning performance of the cloth is not displayed, and dirt may remain on the impression cylinder. Also, in order to make the pressing force of the blade uniform, it is necessary to increase the precision of contact along the full length of the blade. However, a sufficient precision cannot be obtained with the cleaning apparatus described above, and the result is that the cleaning performed by the blade is not uniform.

SUMMARY OF THE INVENTION

In consideration of these problems as mentioned above, an object of the present invention is to provide a cleaning system for offset sheet-fed printing presses, that can easily and definitely remove dirt from the surface of the impression cylinder and that has a means of adjusting the blade contact.

According to the present invention, these and other objects can be achieved by one embodiment of a cleaning system for offset sheet-fed printing presses that comprises: a magazine roll for reeling-out cleaning cloth to perform the cleaning of the impression cylinder, a take-up roll to take-up this cleaning cloth; a blade provided between the magazine roll and the take-up roll and in contact with the impression cylinder from behind the rear side of said cleaning cloth, a guide member to bring the cleaning cloth pressed by the blade, into contact with an arcuate circumferential surface of the impression cylinder and in contact along the axial length of the impression cylinder; a cleaning liquid supply tube provided at the rear surface of the cleaning cloth so as to supply cleaning liquid to the cleaning cloth, and a pressing member provided between the blade and the guide portion so as to press the arcuate circumferential surface of the contact portion of the cleaning cloth against the impression cylinder;

Another embodiment of a cleaning system of the present invention for offset sheet-fed printing presses comprising a magazine roll for reeling-out cleaning cloth to perform the cleaning of the impression cylinder; a take-up roll to take-up this cleaning cloth; a blade provided between the magazine roll and the take-up roll and in contact with the impression cylinder from behind the rear side of said cleaning cloth; a guide member to bring the cleaning cloth pressed by the blade, into contact with the arcuate circumferential surface of the impression cylinder and in contact along the axial length of the impression cylinder; and a cleaning liquid supply tube provided at the rear surface of the cleaning cloth so as to supply cleaning liquid to the cleaning cloth. The blade is provided so as to be freely capable of advancing and retreating with respect to the impression cylinder by means of a support.

An additional embodiment of offset sheet-fed printing presses of the present invention comprises: a magazine roll for reeling-out cleaning cloth to perform the cleaning of the impression cylinder; a take-up roll to take-up this cleaning cloth,, a blade provided between the magazine roll and the take-up roll and in contact with the impression cylinder from behind the rear side of said cleaning cloth; a guide member to bring the cleaning cloth pressed by the blade, into contact with the arcuate circumferential surface of the impression cylinder with in contact along the axial length of the impression cylinder; multiple air cylinders in the direction of the axis of the shaft of the impression cylinder so as to press the blade and the guide portion against the surface of the impression cylinder, and a frame to house the blade, the guide and the air cylinders. The frame is freely movable on rails parallel to the surface of the impression cylinder.

DESCRIPTION OF THE PREFERRED EMBODIMENTS

1. First embodiment

Cleaning system for offset sheet-fed printed presses

1.1 Configuration

Figure 1:
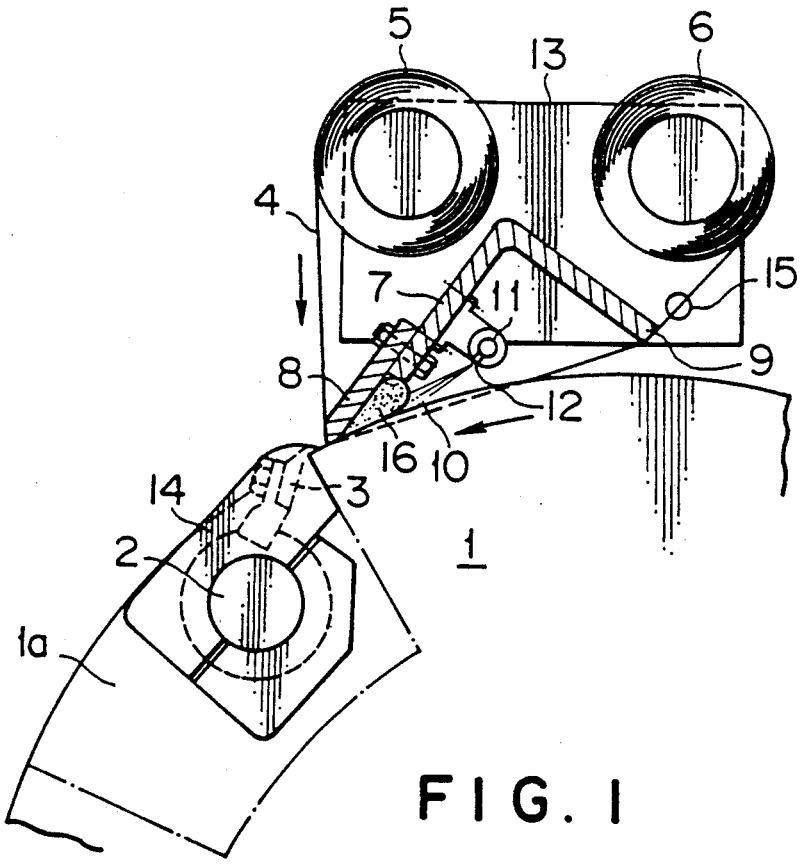
FIG. 1 is a sectional elevation view of a first embodiment of the cleaning system for offset sheet-fed printed presses according to the present invention.
Figure 10:
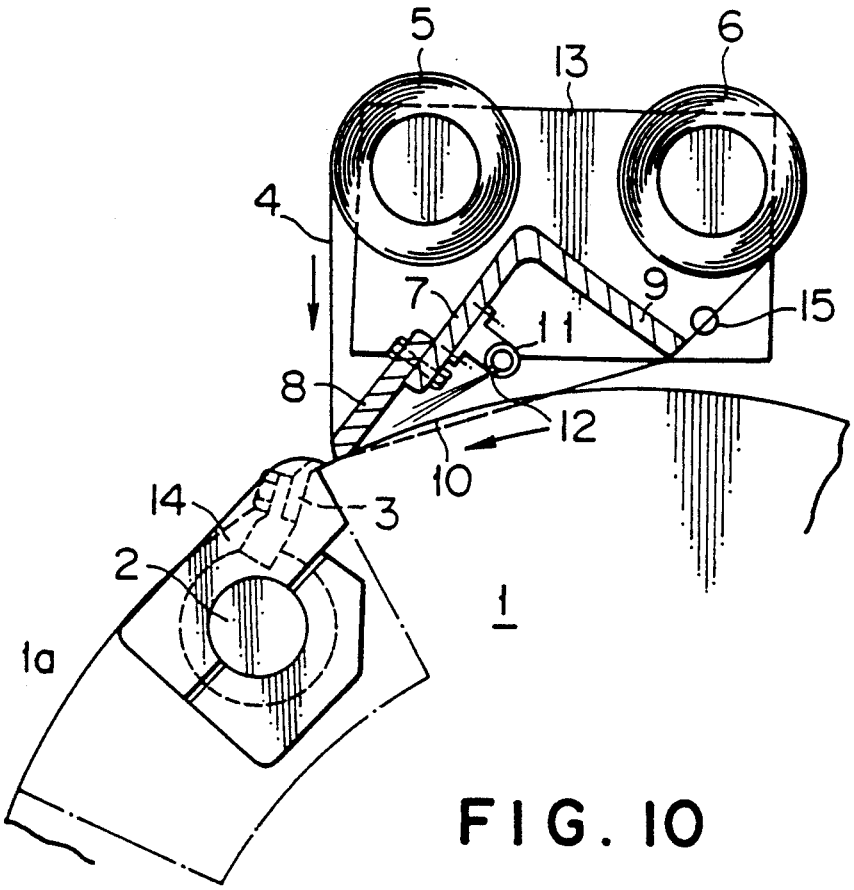
FIG. 10 and FIG. 11 are views indicating conventional cleaning systems.
Figure 11:
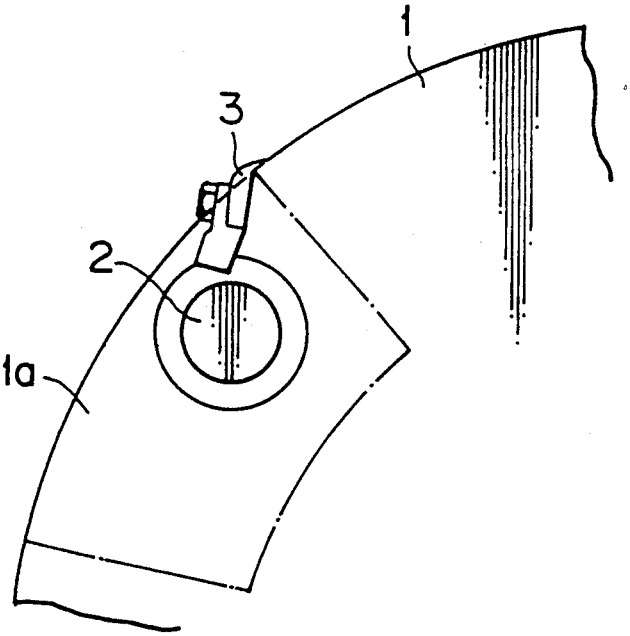

FIG. 1 is a sectional elevation view of a first embodiment of the cleaning system for offset sheet-fed printing presses according to the present invention and shows the status where the cleaning system of the present invention is in contact with the surface of the impression cylinder. The same numerals are used to describe the same members in FIG. 10 which illustrates a conventional cleaning system.

The following is a detailed description of each of the component parts of this embodiment.

The cleaning cloth 4 is in contact with the impression cylinder and is used to directly remove dirt on the impression cylinder. It can absorb water and a cleaning agent and the material is non-woven cloth that has hydrophilic and lipophilic properties.

The magazine roll 5 is provided with a mechanism whereby rolls of the cleaning cloth can be easily mounted and dismounted, and is provided with a brake mechanism so that the cleaning cloth does not slacken when it is progressively unwound from the magazine roll.

The take-up roll 6 allows the used rolls of cleaning cloth to be easily dismounted and empty rolls mounted, and rotates in the direction opposite to the direction of rotation of the impression cylinder.

One end of the inverted-V shaped support plate 7 has and holds the blade 8 and the other end has a guide portion 9 that presses the cleaning cloth 4 against the impression cylinder 1 and also has a cleaning liquid nozzle mounted to spray cleaning liquid onto the cleaning cloth.

At least two finger escape cams 14 are provided inside the profile of the cylinder and are fixed to a finger 3 by the finger shaft 2. Moreover, the cams can be configured so that only the tips of the fingers 3 are in contact so as to allow the cleaning cloth 4 to ride smoothly over the finger portions, and the cam can also be positioned on the surface of the impression cylinder.

The means for moistening the cleaning cloth with cleaning liquid is provided with a cleaning liquid supply pipe 11 and a nozzle 12 so that the cleaning cloth is always kept moist with the cleaning liquid and the cleaning effect is increased. The moistening means is provided with a mechanism so that the cleaning liquid is only sprayed onto the impression cylinder 1. Therefore, although the means for moistening the cleaning cloth with cleaning liquid is provided at the rear of the inverted-V shaped support plate 7 in this embodiment, it is also possible to provide it at any suitable position not part of the cleaning system.

As shown, in FIG. 1 for this embodiment of the present invention, a spongy pressing member 16 is provided at the rear of the blade 8 (downstream from the blade, with respect to the direction of motion of the cleaning cloth) and in contact with the cleaning cloth so that the cleaning cloth 4 is pressed against the arcuate circumferential surface of the impression cylinder 1. Thus, the combined effect of the cleaning effect near the fingers and the cleaning effect due to the contact pressure of the pressing member is obtained. Moreover, an air pad can be used instead of the spongy pressing member 16 or a rubber roll or the like can be flexibly positioned so that it is pressed between the end of the back of the blade and the cleaning cloth.

Figure 2:
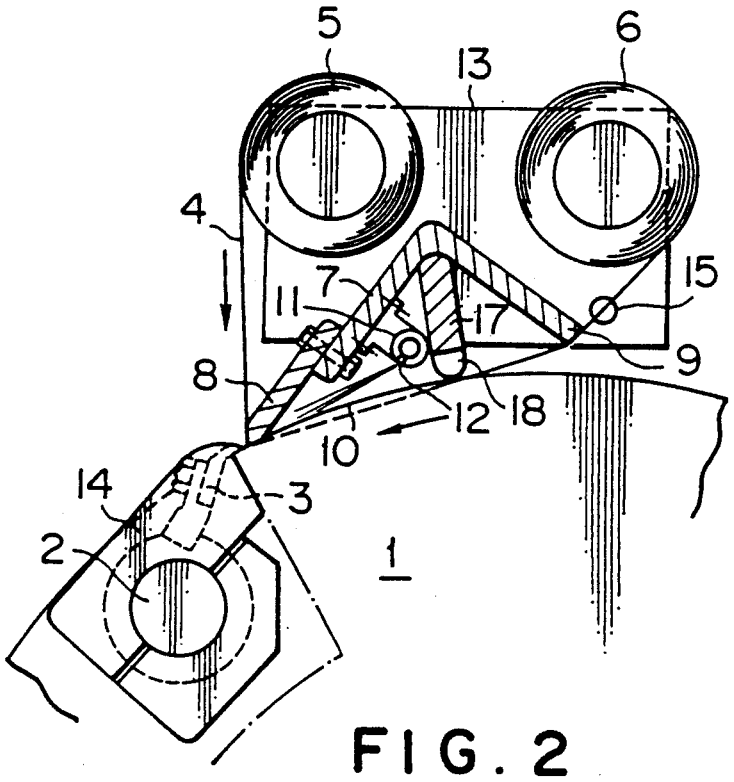
FIG. 2 is a sectional elevation view of another embodiment of the cleaning system shown in FIG. 1.

Furthermore, as shown in FIG. 2, a spongy pressing member 18 can alternatively be provided at the end of the mounting bracket 17 instead of the spongy pressing member 16 provided at the rear surface of the blade 8.

As shown in FIG. 2, a spongy pressing member 18 is provided at the tip of the mounting bracket 17 that extends from the center portion of the inverted-V shaped support plate 7 and towards the side o the impression cylinder 1. This pressing member 18 is pressed by the pressure of the blade 8 such that it is in contact along the surface of the impression cylinder, and thus, the cleaning cloth 4 that performs the cleaning has its contact pressure increased. Moreover, this spongy pressing member 18 is positioned downstream of the arcuate circumferential surface of the contact portion of the cleaning cloth.

Furthermore, an air pad can be used instead of the spongy pressing member 18, or a rubber roll or other type of pressing member or the like can be provided via a pressuring device on mounting bracket 17 so that the cleaning cloth is pressed against the impression cylinder.

It is necessary for the material of the pressing member 16 and pressing member 18 to be resistant to solvents.

1.2 Operation

In the present invention, a finger escape cam 14 is provided on the finger plate shaft 2 of the impression cylinder 1, and the blade 8 presses from the rear of the cleaning cloth 4 and in the axial direction of the impression cylinder 1 so that the cleaning cloth 4 is pressed as a line against the impression cylinder 1 and is further pressed around the arcuate circumferential surface of the impression cylinder 1 by a pad- or roll-shaped pressing member 16, 18 so as to improve the transferability of dirt to the cleaning cloth 4 and so that it becomes possible to clean without any residual portions on the impression cylinder 1 near the fingers 3, and so that it becomes possible to clean away dirt that is difficult to remove through cleaning by only the arced area of contact between the blade 8 and the cleaning cloth 4. In addition, the cleaning cloth 4 rides over the fingers 3 without contacting them. Thus, damage to the cleaning cloth 4 by the fingers 3 is prevented. When only the blade 8 presses the cleaning cloth 4 against the impression cylinder 1, there are often instances of an uneven pressing force across the width of the blade even if the processing precision of the blade 8 has been attempted to be raised, and discrepancies in the thickness of the cleaning cloth 4 mean that non-uniform contact pressure has been unavoidable. However, in addition to pushing the cleaning cloth 4 against the impression cylinder 1 by the use of a blade 8, and by guiding it by a guide portion 9 provided on the side of the take-up roll 6, pressing the cleaning cloth 4 against the surface of the impression cylinder 1 by a pad- or roll-shaped pressing member 16, 18 improves the transfer of dirt to the cleaning cloth 4 and enables the use of a cleaning cloth 4 having a sufficient performance in holding dirt and therefore improves the uniformity of wiping along the axial length of the impression cylinder 1 and also provides an improved cleaning effect.

According to the present invention, the configuration of the mechanism having the above functions and as described above is simple and so the cleaning system can be made to be compact and lightweight so that automation of the impression cylinder cleaning can be performed unlike conventional cleaning systems, and that the cleaning time can be reduced as a result. Additionally, the production efficiency of the printing press can be increased.

2. Second embodiment

Impression cylinder cleaning system where the blade advances with respect to the impression cylinder

2.1 Configuration

Figure 3:
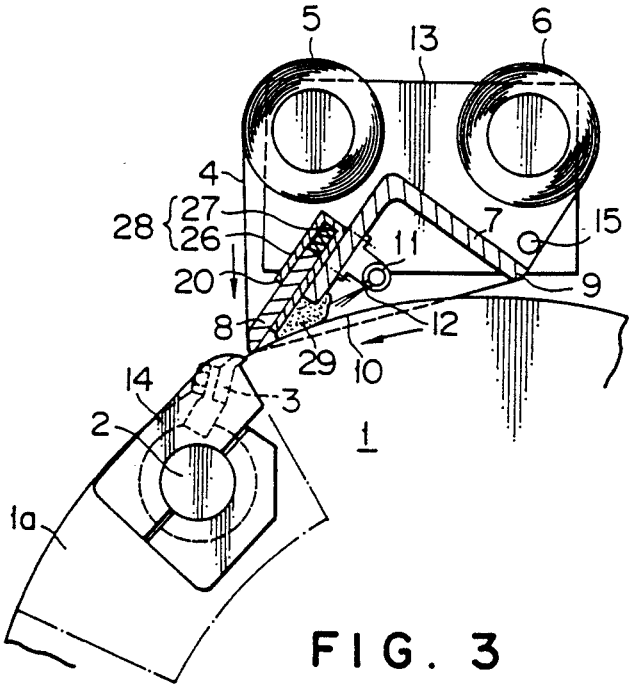
FIG. 3 is a sectional elevation view of a second embodiment of the cleaning system for offset sheet-fed printed presses according to the present invention.
Figure 4:
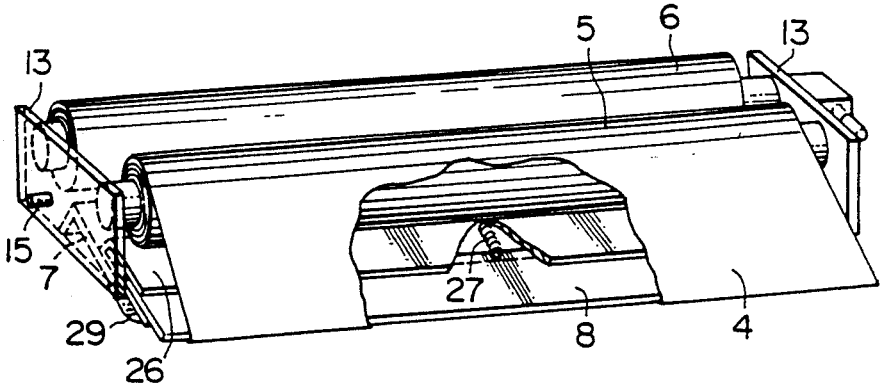
FIG. 4 is a perspective view of the cleaning system shown in FIG. 3.

As can be seen in FIG. 3 and FIG. 4, this embodiment of the present invention, in a conventional cleaning system (refer to FIG. 10), has been provided with a pressing mechanism 28 that outwardly urges a blade 8 inside a guide groove 20 of a guide plate 26 that is U-shaped in section, and which is provided on the surface of the inverted-V shaped support plate 7 of the blade 8.

This is to say that a guide plate 26 that is U-shaped in section is provided at one end of the inverted V-shaped support plate 7, and houses a blade 8 so as to be movable inside a guide groove 20 by a coil spring 27. This blade 8 is arranged so as to uniformly strike the surface of the impression cylinder due to the expansion and contraction of the coil spring 27, and the cleaning cloth 4 is uniformly pressed in a line against the surface of the impression cylinder 1 by the blade 8. Moreover, the guide portion 9 at the other end of the inverted-V shaped support plate 7 is disposed so that the cleaning cloth 4 is brought into contact with the arcuate circumferential surface of the surface of the impression cylinder 1. Moreover, the blade 8 and the guide portion 9 can be independently provided to the frame 13 without the use of the inverted-V shaped support plate 7.

In addition, instead of the coil spring 27, it is possible to use an air cylinder, an oil cylinder, an air pad or an oil pad or the like as a pressing mechanism to forcedly press the blade by applying a uniform force over the entire length of the blade. Moreover, in addition to the cleaning cloth pressing force provided by the plate 8 itself, a flat pressing member such as a felt pad 29 is also provided behind the plate 8 so as to strongly press the cleaning cloth 4 against the surface of the impression cylinder 1 and therefore achieve a further increase in the transferability of dirt to the cleaning cloth 4.

Figure 5:
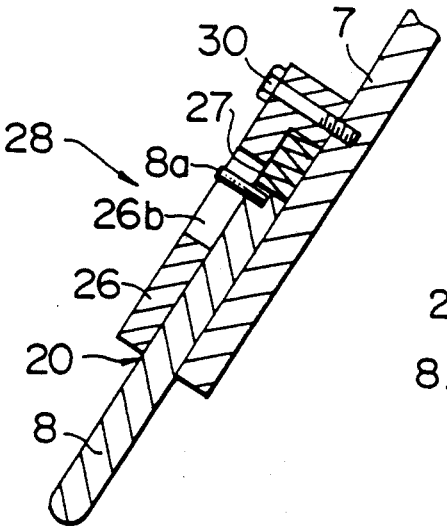
FIG. 5 is a detailed sectional elevation view indicating the blade pressing mechanism.
Figure 6:
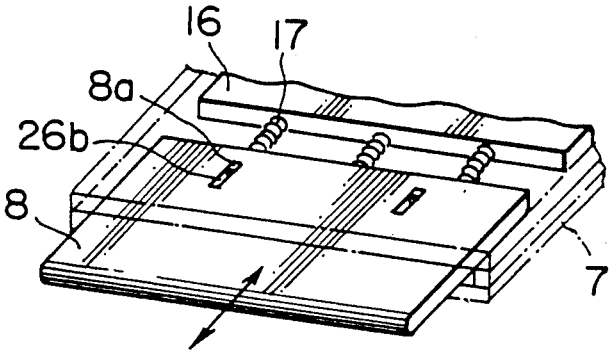
FIG. 6 is a perspective view of the pressing mechanism shown in FIG. 5.

FIG. 5 and FIG. 6 show an alternative embodiment for the blade pressing mechanism 28. This pressing mechanism has guide plate that is L-shaped in section instead of the guide plate that is U-shaped in section.

This is to say that as indicated in FIG. 5 and FIG. 6, the guide plate 26 is fixed by a stop screw 30 so that the guide groove 20 is formed so as to enable the blade 8 to move along a support plate 7, with the coil spring 27 being positioned between the bottom of the guide groove 20 and the blade 8 so that the blade 8 is pushed in the direction of the impression cylinder 1. Moreover, even in cases when the blade 8 is not in contact with the surface of the impression cylinder 1, a guide pin **8*a* embedded in a plate, is engaged with a long groove 26*b* provided in a guide plate 26 so that the blade 8 does not fly out of the guide groove 20 even if there is no contact between the blade 8 and the surface of the impression cylinder 1. In addition, the pad 29 presses the cleaning cloth 4 against the arcuate circumferential surface of the impression cylinder 1 and improves the transfer of the dirt to the cleaning cloth 4 and increases the ability of the cleaning cloth 4** to hold the dirt.

2.2 Operation

In a conventional device, a blade 8 presses the cleaning cloth 4 against the impression cylinder 1 and the combination of a finger escape mechanism enables the cleaning of the impression cylinder of an offset sheet-fed printing press. However, in order to use the blade, it is necessary to have a high level of precision between the end of the blade 8 and the surface of the impression cylinder 1. This requires time, labor, and cost when a new blade has to be introduced into the cleaning system, or exchanged. Because of this, it is possible to think of a method for automatically maintaining a degree of precision between the blade 8 and the surface of the impression cylinder 1 and that involves mounting either an optical or ultrasonic sensor or the like to several places on the end of the blade incorporated into the guide rail and the like, so as to measure the distance and to use the data for the measured distance to generate feedback so that the blade is moved slightly in accordance with this feedback. However, such a system would of necessity be complex.

Therefore, by providing the cleaning system for offset sheet-fed printing presses, according to the present invention, with an automatic adjustment function for the precision at which the blade 8 strikes the surface of the impression cylinder 1, it has been possible to solve this problem and to also facilitate the system introduction and maintenance, etc.

By doing this, it is possible to easily achieve automation and labor saving and increased productivity for the cleaning of the impression cylinder 1 that conventionally had to be performed by hand. Also, although it was not possible for conventional systems to mount a cleaning device to the underside of the impression cylinder where there was little space, the cleaning system according to the present invention enables an automatic accuracy adjustment function to be given to the blade itself so that the restrictive conditions applicable to the device are reduced.

Moreover, in addition to this, by providing a felt pad 29 or other surface pressing material to the rear of the surface of the blade 8, it is possible to achieve a strong force of contact between the cleaning cloth 4 and 0 the arcuate circumferential surface of the impression cylinder 1 for places other than the line of contact created by the blade 8. The result of this is that the cleaning effect is raised.

3. Third embodiment

Impression cylinder cleaning system having an air cylinder for pressing the plate and guide portion

3.1 Configuration

Figure 7:
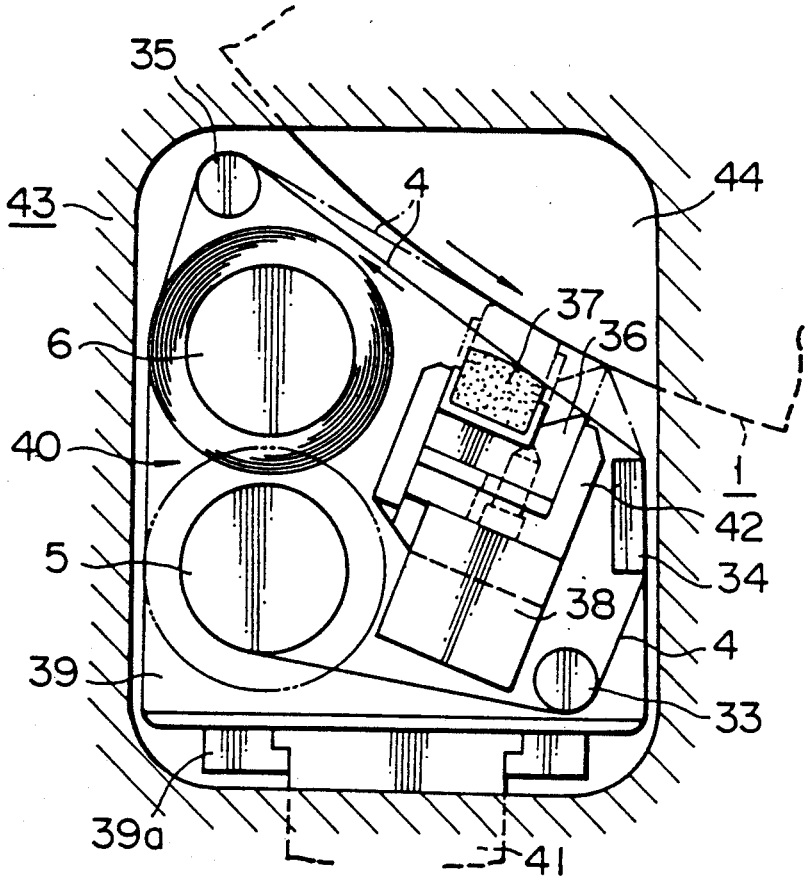
FIG. 7 is a sectional elevation view of a third embodiment of the cleaning system for offset sheet-fed printed presses according to the present invention.
Figure 8:
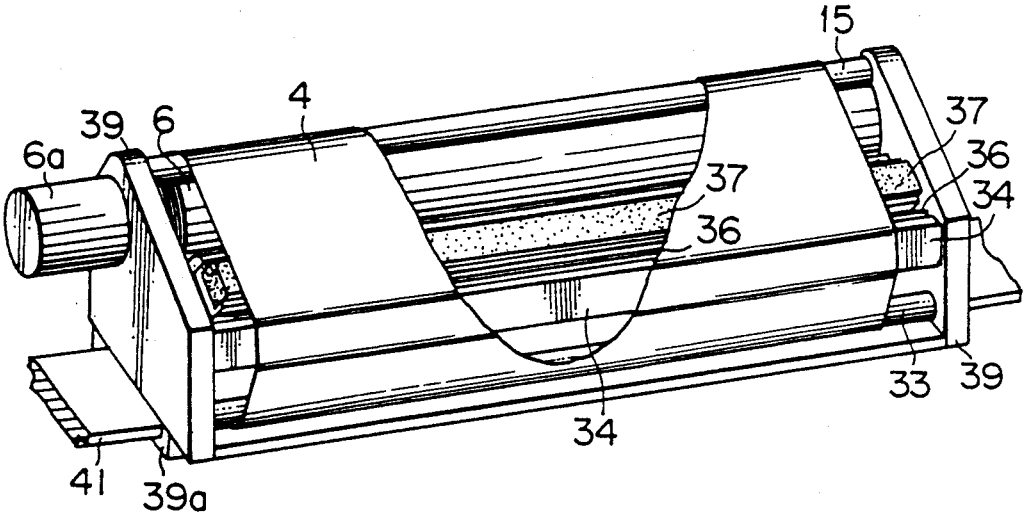
FIG. 8 is a perspective view of the cleaning system shown in FIG. 7.
Figure 9:
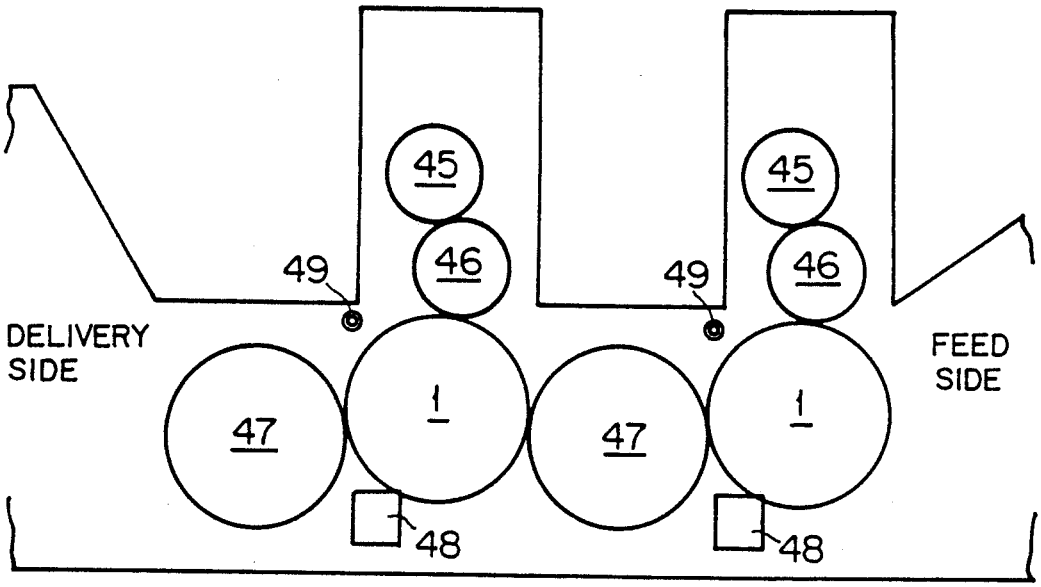
FIG. 9 is a sectional elevation view indicating the overall configuration of a printing press.

The cleaning system according to the third embodiment shown in FIG. 7, FIG. 8 and FIG. 9 is provided at a diagonally lower position where it causes the least obstruction, wherein a cleaning unit 40 comprises a frame 39 housing a magazine roll (with a spring brake) 5 for the cleaning cloth 4 that performs the cleaning of the impression cylinder 1, a take-up roll 6 that is rotated by a take-up servo motor **6*a* to take-up the cleaning cloth 4, a guide roller 33, guide plate 34 and guide roller 35 to guide the cleaning cloth 4 with respect to the impression cylinder 1 and between the magazine roll 5 and the take-up roll 6, a line-contact blade 36 on the rear side of the cleaning cloth 4 so as to press the cleaning cloth 4 onto the arcuate circumferential surface of the impression cylinder 1 between guide plate 34 and guide roller 35, a surface pressure pad 37, and multiple air cylinders 38 in an array to press the pressure pad 37 in the direction of the axis of the impression cylinder 1. This cleaning unit 40 is mounted on parallel rails 41 close to the impression cylinder 1** so that the unit is freely movable and detachable.

However, it is also possible to provide an apparatus having the same mechanism, at the upper part of the impression cylinder. Moreover, in this embodiment, the combination of the magazine roll (with a spring brake) 5 and the servo motor ensures that a constant tensile force is always applied to the cleaning cloth 4 so that a voltage is applied to the servo motor only when the cleaning cloth 4 is to be taken-up, and the necessary amount of cleaning cloth 4 is taken-up. Because of this, there is no interference between the cleaning cloth 4 and the loosening fingers. The power supplied to the cleaning unit 40 is from the same source as that for the printing press and so when there is a power failure, the cleaning unit 40 and the printing press can both be brought to a stop at the same time, and therefore enhance the safety. The line contact blade 36 is a piece of aluminum that has been processed into an L-shape. A material that has been plated with hard chromium can be used to improve the durability. In addition, the surface pressure pad 37 is fixed to the C-shaped aluminum chamber **37*a* by an adhesive and is mounted as a whole to the horizontal part where the line-contact blade 36 for the C-shaped chamber forms an L-shape, the line-contact blade 36 and the surface pressure pad 37 form a single unit, and the multiple air cylinders 38 for pressing, cause the cleaning cloth 4 to be guided by the C-shaped groove guide 42 against the impression cylinder 1 and at the same time for the line-contact blade 36 to be pressed in a line against the impression cylinder 1 and for the surface pressure pad 37 to press against the surface of the impression cylinder 1. In addition, for the linecontact blade 36 and the surface pressure pad 37 to simultaneously press the cleaning cloth 4 against the surface of the impression cylinder 1**, it is necessary for the surface of the sponge to be soft so that it can form an angle of about 5° to 10°, and for the material to be resistant to both solvents and water (P.P., P.E., PVC, etc.).

Such a configuration enables dirt on the impression cylinder 1 to be brought into contact with the cleaning cloth 4 held in line contact by the line-contact blade 36, and therefore be wiped off, and also for other dirt to be wiped off by the cleaning cloth 4 where it is in surface contact. It is of course possible to use rotary actuators in place of the air cylinders 38 used for pressing and the use of hydraulic or electrical drive can be substituted for compressed air drive.

In addition, the cleaning unit 40 can be moved along and fixed upon cleaning unit support rails 41 that are provided parallel to the long direction of the impression cylinder 1 and through an opening 44 in an impression cylinder side support wall 43, so that the repair and parts exchange for the cleaning unit 40 can be easily performed.

In addition, when this apparatus is installed to the upper part of the impression cylinder, special brackets can be provided on both sides instead of the cleaning unit support rails 41.

In the present invention, the cleaning liquid supply device is not incorporated within the cleaning unit 40, but as is shown in FIG. 9, there is a separate unit placed at the diagonal upper left of the impression cylinder 1, to spray cleaning liquid directly onto the surface of the impression cylinder 1. This is to say that as shown in FIG. 9 for a printing press comprising a plate cylinder 45, the blanket cylinder 46, the impression cylinder 1 and the intermediate cylinder 47, the impression cylinder cleaning system according to the present invention is provided at mounting position 48 and the cleaning liquid supply device is provided at mounting position 49.

In addition, dirt on the surface of the impression cylinder 1 can consist of ink residue and also paper powder and Arabia rubber included in the water used for printing and so it is necessary to use water since it is not adequate to use only a solvent as the cleaning liquid. In order to evenly distribute at least two cleaning liquids over the entire surface of the impression cylinder, this embodiment uses a nozzles at a 10 to 50 mm pitch on spray outlets 0.3 to 1.0 mm in diameter that have been opened in brass pipes of 6 to 10 mm in diameter.

In addition, liquid is supplied from both ends of the same cleaning liquid supply pipe 11 so that the same amount (approx. 5 to 15 cc) is applied to the complete width and without any excess liquid entering the cutout portion 1*a* (in FIG. 10), and so that the signals from an encoder (not shown) cause the liquid to be sprayed after the fingers have passed the nozzles. The amount of cleaning liquid supplied from the cleaning liquid supply pipe 11 is only that amount which can be completely absorbed by the cleaning cloth 4. In addition, because air is used to expel the entire amount of cleaning liquid that has been allowed to accumulate to a suitable amount inside the tube, the switched supply of two or more types of cleaning liquid enables application from the same nozzles of the same pipe. Furthermore, fine filters (10 μm to 100 μm meshes) are used for each of the cleaning unit 40 along with other measures to facilitate maintenance and to prevent the clogging of the nozzle discharge holes. In this embodiment, the two types of cleaning liquid are applied by the same nozzles and pipe but depending on the type of dirt or grime to be cleaned, the number of types of cleaning liquid can be increased or special nozzles for each type of cleaning liquid can be used.

Still furthermore, in order to prevent the cleaning cloth 4 from coming into contact with the impression cylinder 1 during the printing process, an air cylinder 48 separates the cleaning unit 40 from the impression cylinder 1 so that the interval between the cleaning cloth 4 and the impression cylinder 1 is about 10 mm. In this embodiment, an encoder (4096 pulses/rotation) is used as the means of detecting the position of the impression cylinder 1 (impression cylinder fingers 3). Alternatively however, a contact sensor, a photoelectric sensor or the like can be provided as the means of detecting the fingers 3, and as in the previously described embodiment, a finger release cam 14 can be used to avoid contact with the fingers. A spring is incorporated as a safety mechanism in order to prevent the line-contact blade 36 and the surface pressure pad 37 from separating from the impression cylinder 1 and a proximity sensor is used to detect the operation of the pressure contact portion s that the operation of the printing press and the cleaning system is stopped should an abnormality be detected.

3.2 Operation

According to the present invention, the line-contact blade 36 and the surface pressure pad 37 on the rear side of the cleaning cloth 4 with respect to the impression cylinder 1, are pressed towards the impression cylinder 1 by a plural number of air cylinders 38 provided in a line along the length so that the line-contact blade 36 and surface pressure pad 37 are pressed towards the impression cylinder 1 at a uniform pressure along their entire length, and so that the pressure force of the surface pressure pad 37 is added to the line-contact pressure of the cleaning cloth 4 with respect to the arcuate circumferential surface of the impression cylinder 1 and so that unlike cleaning systems where a conventional pad is used to press the cleaning cloth against the impression cylinder, more uniform and effective cleaning can be performed for from the fingers to the tail end of the impression cylinder. Moreover, the combination of the line-contact blade 36 and the surface pressure pad 37 enables the cleaning time to be shortened when compared to the method where only a surface pressure pad 37 is used to press the cleaning cloth 4 against the impression cylinder 1, and the method where only a line-contact blade 36 is used to achieve the same. In addition to this, the relative position of the cleaning cloth 4 with respect to the impression cylinder 1 can be freely changed by the multiple number of air cylinders 48 upon the detection of the finger position by encoder signals from the rotation of the impression cylinder. It is therefore not necessary to provide a finger escape cam 14 to enable control for the separation of the cleaning cloth 4 from the fingers 3. In addition, the cleaning unit 40 can be moved and fixed along cleaning unit support rails 41 in the direction of the length of the cylinder so as to facilitate the repair and exchange of the cleaning unit.

Furthermore, the solvent cleaning, water cleaning drying and other operations can be performed by the impression cylinder cleaning system of the present invention, as a predetermined sequence incorporated into a control device that is started by an operator pressing the cleaning start button.

Accordingly, the cleaning of the impression cylinder is simplified and automated to result in labor savings and increased productivity, and the cleaning system of the present invention can be easily mounted to the bottom portion of printing presses where this had been previously impossible due to lack of space for adjustment of the contact precision between the blade and the impression cylinder.

Figure 12:
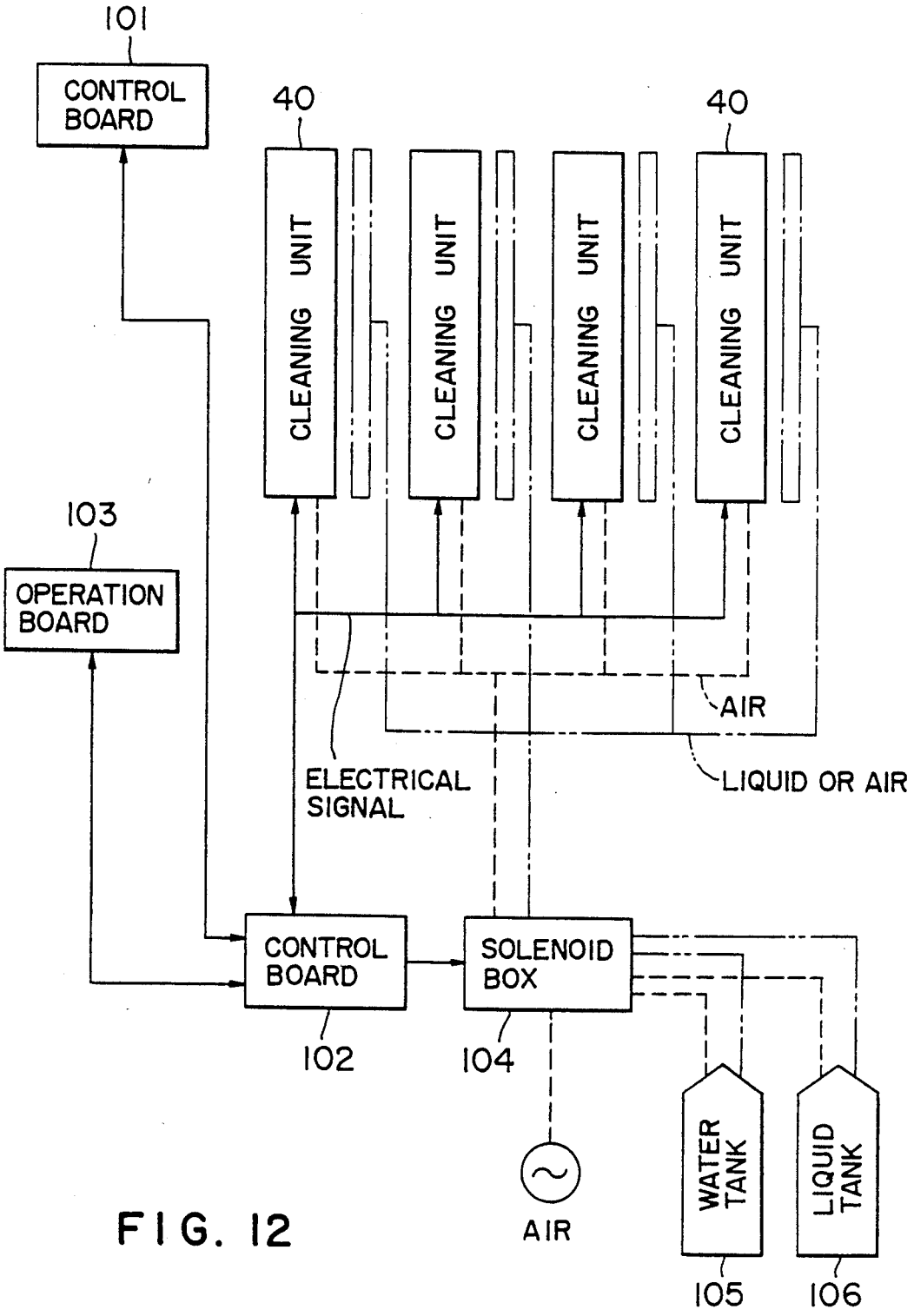
FIG. 12 is a diagram indicating the operation of the third embodiment of the present invention.

In this embodiment, the amount of cleaning cloth remaining is detected by a contact sensor on the other side of the cleaning cloth from a metal rod. As shown in FIG. 12, when the amount of cleaning cloth remaining becomes about 50 cm, a "cleaning cloth almost completely used" signal is generated by the cleaning unit 40 and input to a control device 102. If the "cleaning cloth almost completely used" signal is generated during cleaning, then the control board 102 generates a signal to prohibit the cleaning operation for the next time, and sends it to a control board 101. At the same time the control board 102 generates a signal input to an abnormality monitoring function of the operation board 103 to indicate that there is only a small amount of cleaning cloth remaining. Also, the control board 102 sends signals to a solenoid box 104 to control the amount of cleaning liquid supplied. In addition, the amounts remaining in tanks 105, 106 are detected by a flow switch, and when the amounts of cleaning liquid and water become less than certain predetermined amounts, "cleaning liquid [water]tank almost empty" signals are generated and input to the control board 102. When this occurs, the control board 102 generates signals input to the abnormality monitoring function of the operation board 103 to display that there is only a small amount of cleaning liquid [water]remaining.

What is claimed is:

1. A cleaning system for cleaning an impression cylinder in an offset sheet-fed printing press, comprising:

a cleaning cloth, a magazine roll for reeling-out said cleaning cloth;

a take-up roll for reeling-in said cleaning cloth;

a blade provided within a loop of said cleaning cloth which is disposed around said magazine roll and said take-up roll, said blade contacting a surface of said cleaning cloth which does not contact the impression cylinder;

a cleaning liquid supply tube provided adjacent the impression cylinder for alternatively air spraying two or more types of liquid from both ends of said supply tube;

a guide member for urging said cleaning cloth into contact with an arcuate circumferential surface of the impression cylinder along the axial length of the impression cylinder;

a pad provided between said blade and said guide member for pressing said cleaning cloth against the impression cylinder, said pad consisting of a material resistant to solvents;

multiple air cylinders for passing said blade and said pad against said surface of the impression cylinder; and a frame housing said blade, said guide member and said air cylinders, support rails provided along the axial length of said impression cylinder, said frame being mounted on said rails and being freely movable on said rails parallel to the surface of the impression cylinder.

2. The cleaning system of claim 1, further comprising a detector device for detecting the position of a finger of the impression cylinder, signals from said detector device being used to drive said air cylinder to advance and retreat said blade and said pad to and from the impression cylinder.

3. A cleaning system for cleaning an impression cylinder in an offset sheet-fed printing press, comprising:

a cleaning cloth;

a magazine roll for reeling-out said cleaning cloth;

a take-up roll for reeling-in said cleaning cloth;

a blade provided within a loop of said cleaning cloth which is disposed around said magazine roll and said take-up roll, said blade contacting a surface of said cleaning cloth which does not contact the impression cylinder;

a cleaning liquid supply tube provided adjacent said surface of said cleaning cloth for air spraying two or more types of liquid from both ends of said supply tube;

a guide member for urging said cleaning cloth into contact with an arcuate circumferential surface of the impression cylinder along the axial length of the impression cylinder; and a pressing member provided between said blade and said guide member for pressing an arc-shaped portion of said cleaning cloth against the impression cylinder.

4. The cleaning system of claim 3, wherein said pressing member is provided adjacent and upstream from said blade, with respect to a rotational direction of the impression cylinder.

5. The cleaning system of claim 3, wherein said pressing member is provided at an upstream end, with respect to a rotational direction of the impression cylinder, of an area where said blade contacts said surface of said cleaning cloth and the impression cylinder.

6. A cleaning system for cleaning an impression cylinder in an offset sheet-fed printing press, comprising:

a cleaning cloth a magazine roll for reeling-out said cleaning cloth;

a take-up roll for reeling-in said cleaning cloth;

a blade provided within a loop of said cleaning cloth which is disposed around said magazine roll and said take-up roll, said blade substantially constantly contacting a surface of said cleaning cloth which does not contact the impression cylinder by a pressing mechanism;

a cleaning liquid supply tube provided adjacent said surface of said cleaning cloth for air spraying two or more types of liquid upon said cleaning cloth from both ends of said supply tube;

a guide member for urging said cleaning cloth into contact with an arcuate circumferential surface of the impression cylinder along the axial length of the impression cylinder; and a pressing member provided between said blade and said guide member for pressing an arc-shaped portion of said cleaning cloth against the impression cylinder.

7. The cleaning system of claim 6, wherein said pressing member is provided at an upstream end, with respect to a rotational direction of the impression cylinder, of an area where said blade contacts said surface of said cleaning cloth and the impression cylinder.

8. The cleaning system of claim 7, said pressing mechanism further comprising a guide plate forming a guide groove mounted to a supporting body, said blade being freely movable within said guide groove and forcedly urged against the impression cylinder by a flexible member.

9. The cleaning system of claim 8, wherein said guide plate has a long groove formed in the direction of movement of said blade, and said blade has a guide pin mounted to engage with the inside of said long groove.

* * * * *